United States Patent [19]

Dillner et al.

[11] Patent Number: 4,688,337

[45] Date of Patent: Aug. 25, 1987

[54] BUCKLE TYPE FASTENER

[75] Inventors: James Dillner, Lancaster, Pa.; Dale Smous, Coral Springs, Fla.

[73] Assignee: National Molding Corporation, Farmingdale, N.Y.

[21] Appl. No.: 811,895

[22] Filed: Dec. 20, 1985

[51] Int. Cl.[4] ..... A44B 11/25

[52] U.S. Cl. ..... 24/616; 24/615

[58] Field of Search ..... 24/616, 615, 323, 313, 24/171, 194, 196

[56] References Cited

U.S. PATENT DOCUMENTS

| | | | |
|---|---|---|---|
| 807,150 | 12/1905 | Boice . | |
| 1,141,575 | 6/1915 | Naylor | 24/616 |
| 1,156,267 | 10/1915 | Blank | 24/616 |
| 1,324,629 | 12/1919 | Tabler . | |
| 1,429,155 | 9/1922 | Metcalf | 24/313 |
| 1,477,597 | 12/1923 | Schneider | 24/616 |
| 1,737,246 | 11/1929 | Jones | 24/616 |
| 1,999,167 | 4/1935 | White | 24/73 |
| 2,181,966 | 12/1939 | Dean . | |
| 2,316,846 | 4/1943 | Diebold | 24/200 |
| 2,560,530 | 7/1951 | Burdick . | |
| 2,758,498 | 8/1956 | Johnson . | |
| 2,836,215 | 5/1958 | Rapata . | |
| 3,040,401 | 6/1962 | Von Rath . | |
| 3,132,390 | 5/1964 | Boden | 24/30.5 |
| 3,167,835 | 2/1965 | Bengtsson | 24/230 |
| 3,192,588 | 7/1965 | White | 24/200 |
| 3,430,306 | 3/1969 | Tareau | 24/615 |
| 3,564,670 | 2/1971 | Bengtsson | 24/126 |
| 3,611,861 | 10/1971 | Schulze . | |
| 3,777,052 | 12/1973 | Fegen . | |
| 3,798,711 | 3/1974 | Cousins | 24/196 |
| 3,845,575 | 11/1974 | Boden | 24/115 H |
| 3,909,883 | 10/1975 | Fegen . | |
| 3,965,544 | 6/1976 | Boden | 24/136 R |
| 3,979,934 | 9/1976 | Isenmann | 24/615 |
| 4,150,464 | 4/1979 | Tracy | 24/196 |
| 4,156,574 | 5/1979 | Boden | 403/211 |
| 4,171,555 | 10/1979 | Bakker et al. | 24/200 |
| 4,342,140 | 8/1982 | Lacey | 24/373 |
| 4,395,803 | 8/1983 | Krauss | 24/200 |
| 4,398,324 | 8/1983 | Bakker et al. | 24/230 R |
| 4,525,901 | 7/1985 | Krauss | 24/200 |
| 4,559,679 | 12/1985 | Downey | 24/615 |
| 4,569,106 | 2/1986 | Lovato | 24/615 |

FOREIGN PATENT DOCUMENTS

| | | | |
|---|---|---|---|
| 0095656 | 7/1983 | European Pat. Off. | 24/323 |
| 2226129 | 11/1974 | France | 24/616 |
| 2451175 | 11/1980 | France | 24/616 |
| 0144427 | 6/1920 | United Kingdom | 24/616 |
| 970611 | 9/1964 | United Kingdom . | |

*Primary Examiner*—Victor N. Sakran

*Attorney, Agent, or Firm*—Kenyon & Kenyon

[57] ABSTRACT

A two piece buckle type fastener including a receptacle and clasp. The clasp includes a base, a substantially rigid stem protruding from the base, a pair of resilient arms extending from the stem, and locking means on the arms. The receptacle includes a body that defines a cavity adapted to receive and to cooperatively engage the pair of resilient arms within the cavity. The fastener also includes means for disengaging the locking means so that the receptacle and clasp can be separated.

26 Claims, 6 Drawing Figures

Fig. 3.
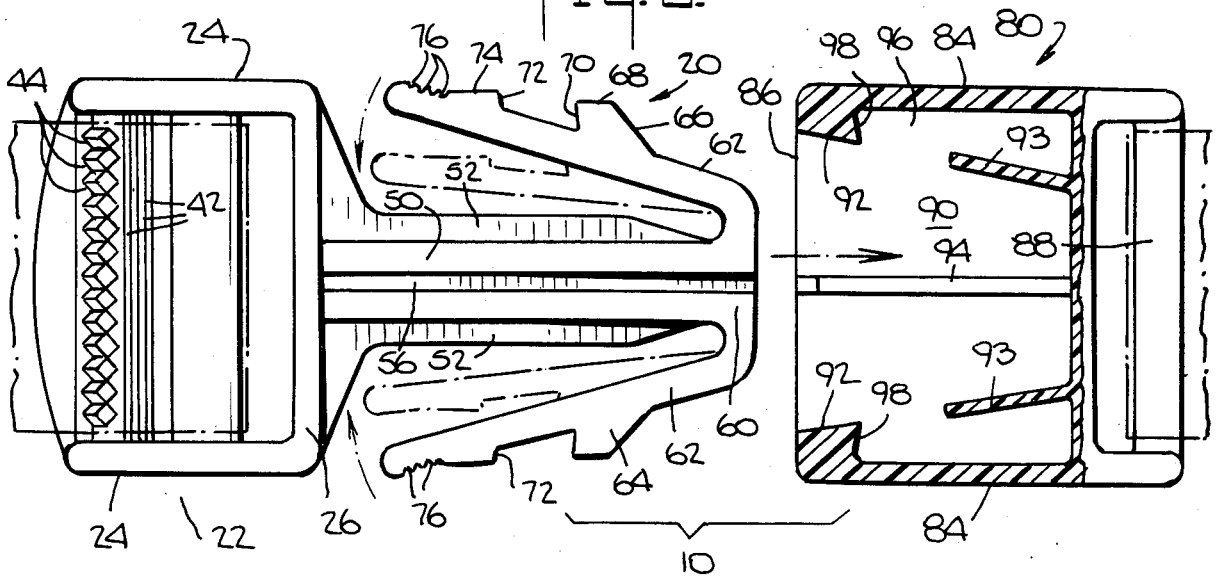
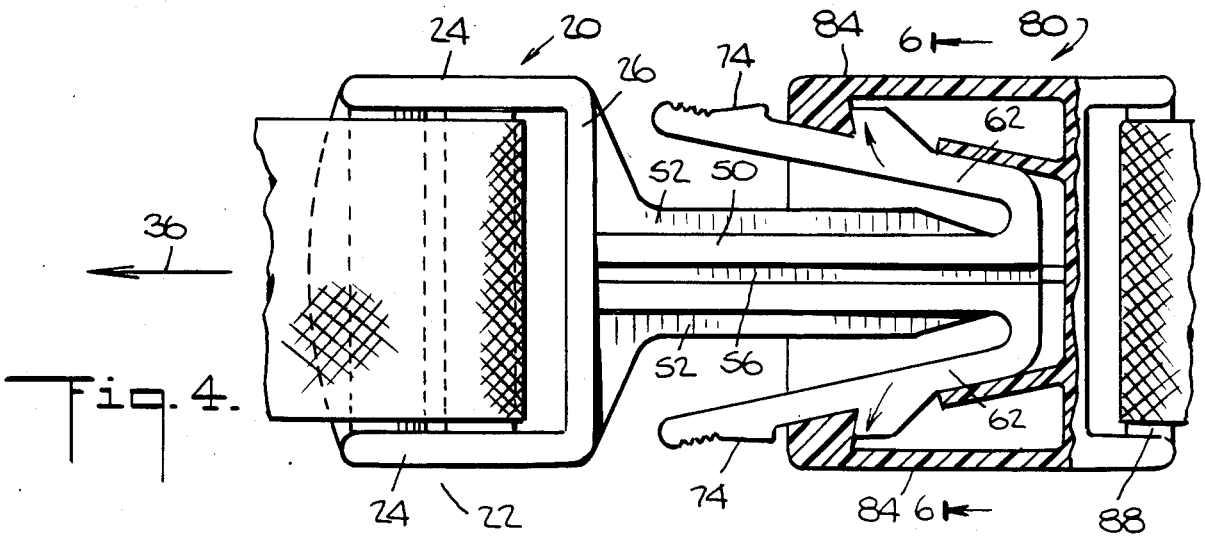
Fig. 4.
Fig. 5.
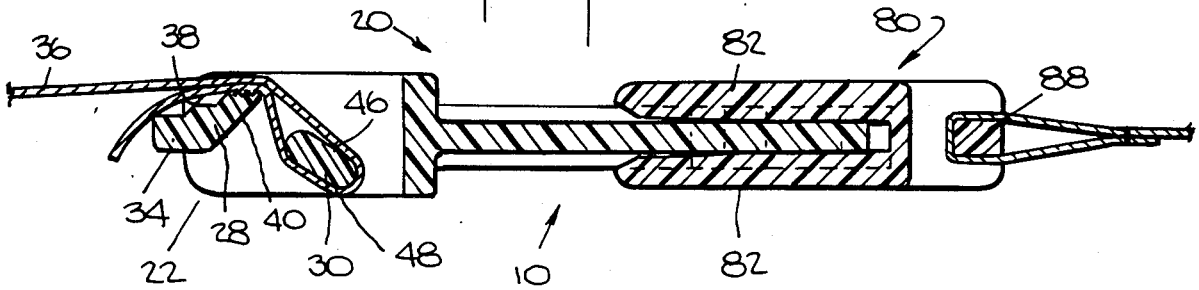

BUCKLE TYPE FASTENER

BACKGROUND OF THE INVENTION

This invention relates generally to a buckle type fastener, and more particularly to a fastener made up of two separable pieces.

Two piece buckle fasteners are incorporataed into leisure, camping, sports, and safety products. Typically they are employed to fasten together the two ends of a belt, for example in a backpack or a life jacket.

Tracy, U.S. Pat. No. 4,150,464, discloses a separable buckle wherein two parallel resilient arms of the clasp piece are each provided with a tab that locks into a corresponding slot in a receptacle piece. A central rigid arm is provided with stop means that limit the bending of the resilient arms.

Cousins, U.S. Pat. No. 3,798,711, discloses a separable buckle wherein the frame portion of the male piece has an obliquely disposed resilient tongue that terminates to define a shoulder facing the free end portion of the male piece. To fasten the buckle, the frame portion of the male piece is positioned within the housing, and the shoulder of the tongue engages a bar in the housing that defines a fenestration therein.

For many applications, and most dramatically in the safety applications, it is desirable for a fastener to be easily and quickly fastened, notwithstanding that the operator may be hurried or distracted, and at the same time be readily released when desired and resistant to stress that might cause accidental release. In view of the foregoing, it is advantageous to provide a buckle type fastener that more successfully combines the properties of easy fastening and security against accidental release.

SUMMARY OF THE INVENTION

In general, the invention provides a two piece fastener that includes a receptacle and a clasp. The clasp includes a base, a substantially rigid stem protruding from the base, a pair of resilient arms extending from the stem and locking means on the arms. The receptacle includes a body that defines a cavity adapted to receive and to cooperatively engage the pair of resilient arms within the cavity. The fastener also includes means for disengaging the locking means so that the receptacle and clasp can be separated.

In preferred embodiments: the receptacle has two substantially parallel side surfaces, substantially parallel top and bottom surfaces, and an opening at one end adapted to receive the clasp piece, the opening forming a cavity within the body of the receptacle, the cavity defining top and bottom inside surfaces, and substantially parallel side inside surfaces, each of the top and bottom inside surfaces having a lock receiving means; and the rigid stem extends substantially centrally from and normal to the base of the clasp, and the resilient arms extend from the distal portion of the rigid stem.

In further preferred embodiments, the resilient arms extend back toward the base of the clasp to form an arrowhead shape, the fastener has guide means for guiding the clasp into the cavity of the receptacle, and the receptacle and clasp include means for attaching a belt thereto.

The fastener of the invention can be fastened quickly and easily; the pieces are readily aligned and located with respect to each other. Furthermore, the fastener is remarkably secure. When the fastener is fastened, any force exerted to pull apart the receptacle and clasp pieces will make the pieces more secure.

Other features and advantages of the invention will be apparent from the following description of the preferred embodiment, from the Figures, and from the claims.

BRIEF DESCRIPTION OF THE DRAWINGS

FIG. 3 is a top view of the two separate pieces, showing a cut away view of the receptacle piece and demonstrating with phantom lines the range of movement of the resilient arms.

FIG. 4 top view showing the two pieces fastened together, showing cutaway view of the receptacle piece.

FIG. 5 is a cut away elevational view along the main central axis of the fastener.

DESCRIPTION OF THE PREFERRED EMBODIMENT

Figure 1:
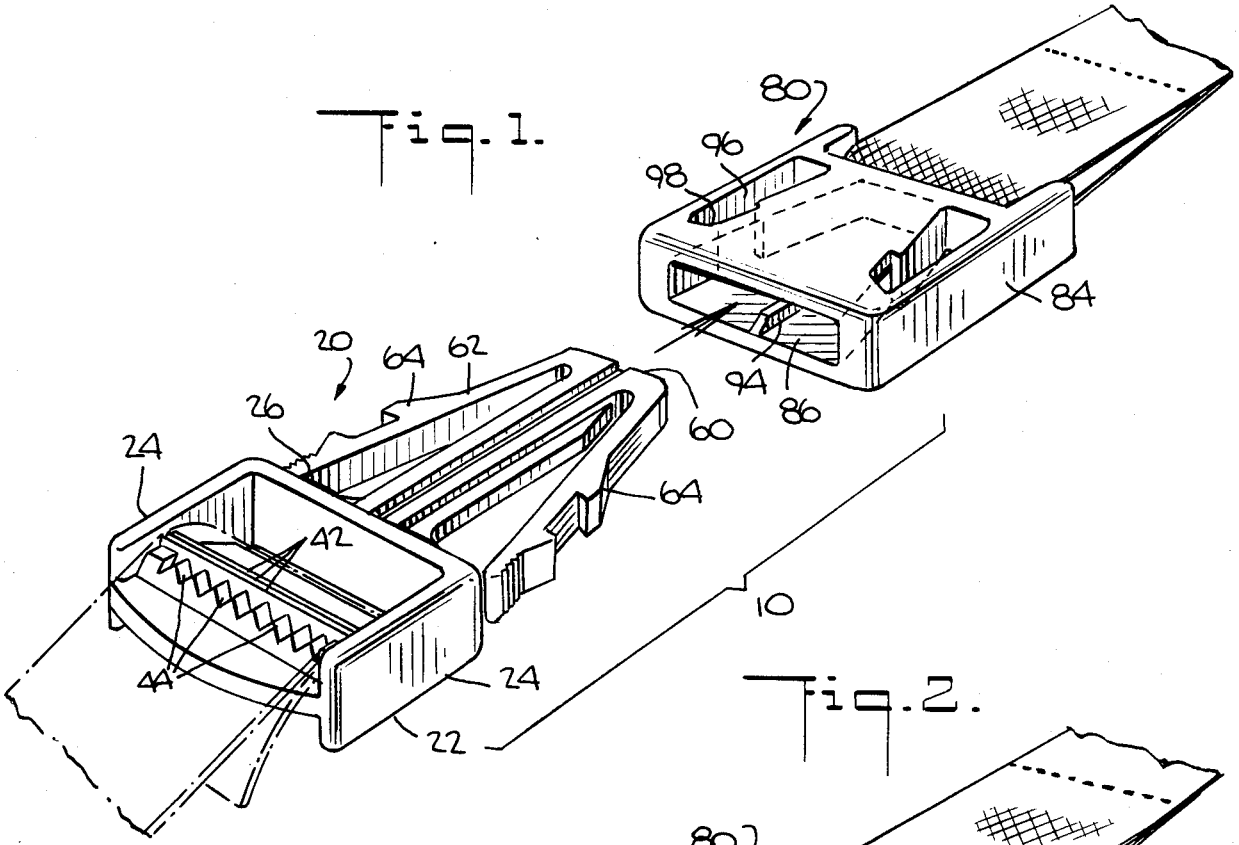
FIG. 1 is a perspective view of the fastener, showing the two separate pieces, with the internal features of the receptacle piece, in phantom.
Figure 2:
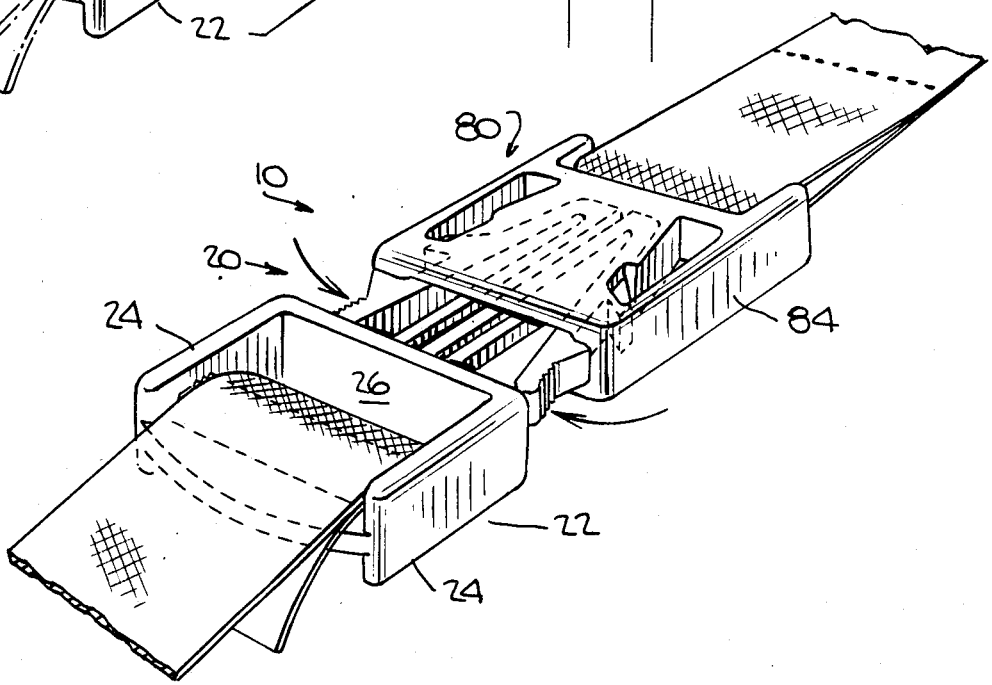
FIG. 2 is a perspective view of the fastener showing the two pieces fastened together, with the portion of the clasp piece that is within the receptacle in phantom.
Figure 6:
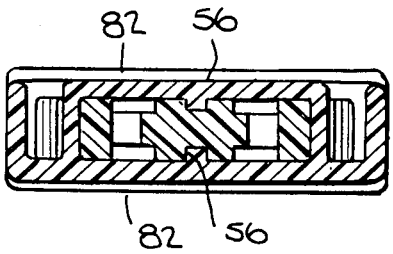
FIG. 6 is a cutaway elevational view of the fastener taken along line 6—6 of FIG. 4.

Referring to FIG. 1, there is shown a buckle, generally identified by reference number 10, including a clasp piece 20 and a receptacle piece 80.

The base portion 22 of clasp piece 20 comprises sides 24, top 26, and transverse bars 28 and 30. The bars are arranged to provide a means for adjustably fastening a belt or other web like material to the clasp piece. In cross section bar 28 has generally a parallelogram shape. Its top and bottom surfaces, 32 and 34 respectively, are parallel to the main axis 36 of the clasp piece, while sides 38 and 40 of bar 28 are offset approximately 45° . The top surface 32 is provided with a plurality of transverse ridges 42, that can serve to hold a belt fast to the clasp piece when the belt has been fed through bars 28 and 30, adjusted to the desired length, and pulled taut. Perpendicular teeth 44 prevent the belt from gathering or binding if the clasp is twisted about its main axis. Bar 30 in cross section has parallel top and bottom surfaces, 46 and 48 respectively, and rounded ends. Bar 32 is located below main axis 36 and offset about 30° . A projection of top surface 46 of bar 30 would intersect with side surface 40 of bar 28 near its intersection with top surface 32.

Rigid stem 50 extends from the center of and normal to base portion 22 of clasp piece 20, along main axis 36. Flanges 52 lie on opposite sides of stem 50, flaring toward its base and providing rigid support to the arm. Grooves 56 are disposed along the length of stem 50, midway between flanges 52.

Extending from distal end 60 of rigid stem 50 are elongated resilient arms 62. These arms are mirror images of each other, essentially straight, and extend back from the distal end of rigid stem 50 toward the base 22 of clasp piece 20. The angle included between either one of the resilient arms 62 and rigid stem 50 is about 15° . Roughly midway along the length of each resilient arm 62 is a tab 64. Referring now to FIG. 3, a first, leading edge 66 of tab 64 forms an obtuse angle with flexible arm 62. A second edge 68 of tab 64 is just a few degrees, preferably about 4°, from parallel with main axis 36 and a third, engaging edge 70 of tab 64 forms an acute angle with the second edge 68, preferably about 80°, so that engaging edge 70 is about 6° from normal to main axis 36. Distal to tab 64, resilient arm 62 flares abruptly to form a surface 72. A surface 74 of arm 62 distal to surface 72 is curved concavely and provided with ridges 76, adapted for engagement with a thumb or other finger of the user.

The receptacle piece 80 is generally rectangular in shape, having substantially parallel, relatively wider side surfaces 82, relatively narrower top and bottom surfaces 84, an opening 86 at one end adapted to receive the rigid stem 50 and resilient arms 62 of clasp piece 20, and a bar 88 at the opposite end adapted for fixedly attaching thereto a belt or webbed material. The opening 86 opens into a main cavity that is defined by substantially parallel inside side surfaces 90 and tapering top and bottom inside surfaces. Side surfaces 90 flare outward at the opening. Extending the length of side surfaces 90 along main axis 36 are ridges 94 adapted to engage grooves 56. Both the top and bottom inside surfaces form angles of approximately 11° with the main axis 36. Each of the top and bottom inside surfaces comprises an outermost portion 92 and a resilient innermost portion 93, separated by inner cavity 96, which is adapted to receive tab 64. The engaging surface 98 of inner cavity 96 is about 10° from normal to the main axis 36.

In operation, the rigid stem 50 and resilient arms 62 of clasp piece 20 are inserted through the opening 86 of receptacle piece 80. Since both the clasp piece and the receptacle piece are symmetrical about the central main axis, the buckle will fasten securely even if one piece is twisted 180° from its usual orientation. The arrangement of the resilient arms 62 attached to distal end 60 of rigid stem 50 forms an arrowhead shape that facilitates proper alignment of the pieces. Even if the receptacle and clasp pieces are initially not properly aligned, the arrowhead shape of the clasp will naturally correct any misalignment as the clasp is inserted into the receptacle. The flared opening of the receptacle also facilitates proper alignment of the pieces as well.

As the rigid stem 50 and resilient arms 62 are inserted into the main cavity of receptacle piece 80, ridges 94 engage grooves 56 guiding the clasp 20 into proper engagement with the receptacle 80. As the clasp is further inserted, the leading edge 66 of tab 64 contacts the edge of opening 86. Any further insertion causes resilient arms 62 to bend inwardly as the second edge 68 of tab 64 slides along the outermost portion 92 of the top and bottom inside surfaces. When clasp and receptacle pieces are in the lock position, tab 64 is aligned with inner cavity 96, which is large enough to receive tab 64. Resilient arms 62 spring outwardly and tabs 64 fit snugly in cavity 96. Engaging edge 70 of tab 64 abuts engaging surface 98 of cavity 96, thus locking together clasp piece 20 and receptable piece 80. In the locked position, the portion of each arm 62 proximal to tab 64 contacts and resiliently engages the resilient innermost portion 93 of the top or bottom inside surface.

The locking mechanism, which includes the tabs and cavities, provides an unusual degree of security to the buckle. Any force tending to pull apart the fastened buckle will cause resilient arms 62 to bend outwardly, thereby tightening the engagement of the fastened buckle pieces. It will be noted that the engaging surface 98 of the cavity is not parallel with the engaging edge 70 of the tab. The engaging surface of the cavity is offset about 10° from normal to the main axis; the engaging edge of the tab is similarly offset about 6°. It should be appreciated that the benefit of increased security will also be achieved if the engaging edge 70 and engaging surface 98 are substantially parallel to each other, so long as they are offset slightly from normal to main axis 36. It is not necessary that the engaging pieces be skewed relative to each other.

Although the lock mechanism of the fastener can withstand substantial opening forces, it can be easily and conveniently released when desired. To release the fastener, the user simultaneously depresses resilient arms 62 by grasping and squeezing together the distal ends 74 of the resilient arms. The resilient engagement of arms 62 with the resilient innermost portions 93 of top and bottom inside surfaces assists disengagement of the fastener by supplementing the pressure exerted by the user on arms 62 to effect disengagement. Because release requires simultaneous depression of both resilient arms, the fastened buckle is unlikely to release accidently. Accidental release is further prevented if the resilient arms 62 do not protrude from the buckle, but lie flush with the top and bottom surfaces of the buckle.

The buckle and clasp pieces of the invention are advantageously produced by integrally molding nylon acetal, polypropylene or any other similar material.

USE

The buckle of the invention is extremely versatile and adapted to many uses in the leisure, camping, sports and safety markets. The buckle can be manufactured in a range of sizes, and the means for securing a belt or web like material to the clasp and receptacle pieces can be modified for specific uses. For example, the buckle of the invention can be used to secure the belts of a life jacket, backpack, or the like. The buckle can be used to secure shoulder straps or handles on luggage.

OTHER EMBODIMENTS

Other embodiments are within the following claims. For example, a buckle according to the invention could have only a single resilient arm. The angle included by the resilient arms can vary from the preferred angle of 30°, within the range of about 20° and about 90°. The angles of the engaging surfaces, relative to each other and relative to the main axis, can vary as well. The slots extending the length of the rigid arm and comprising the guide means can meet, effectively splitting the rigid arm longitudinally along axis 36 into two separate pieces. The cooperating grooves, then, could form a wall that connects the two inside side surfaces. Alternatively, the guide means can include a ridge extending the length of the rigid arm and a cooperating groove in the receptacle piece. Alternatively, the guide means can be dispensed with entirely. Fasteners manufactured from plastics other than those enumerated above or from other material, e.g., metal, are within the scope of the invention.

What is claimed is:

1. A two piece fasteners comprising:

a receptacle and a clamp;

the clasp comprising a base, a substantially rigid stem protruding therefrom, a pair of resilient arms extending from the stem, and locking means on the arms;

the arms extending back toward the base of the clasp to form an arrowhead shaped so that when the clasp and receptacle are pulled apart without releasing the locking means they become more tightly engaged;

the receptacle comprising a body that defines a cavity adapted to receive and to cooperatively engage the pair of resilient arms within the cavity;

wherein each locking means comprises an engaging surface extending from an outside surface of the resilient arms and a lock receiving means for cooperatively engaging the engaging surface with the receptacle;

first guide means extending from the distal end along the substantial portion of the length of the rigid stem and a cooperating second guide means extending along an inside surface of the cavity, the first guide means comprising a slot that runs longitudinally through the rigid stem, splitting the stem into two separate pieces; and means for disengaging the locking means disposed on the resilient arms so that the receptacle clasp can be separated.

2. The fastener of claim 1, wherein:

the receptacle comprises two substantially parallel side surfaces, and an opening at one end adapted to receive the clasp piece, the opening forming a cavity within the body of the receptacle, the cavity defining top and bottom inside surfaces, and substantially parallel side inside surfaces, each of the top and bottom inside surfaces having a lock receiving means; and the rigid stem extends substantially centrally from and normal to the base of the clasp, and the resilient arms extend from the distal portion of the rigid stem.

3. The fastener of claim 2, wherein the included angle between the rigid stem and any of the resilient arms is about 15°, and the included angle between the resilient arms is about 30°.

4. The fastener of claim 1, wherein the first guide means comprises two elements that extend from the distal end along a substantial portion of opposite sides of the resilient member, and the second guide means comprises two elements, one along two opposite inside surfaces of the cavity, each element of the second guide means cooperating with the respective element of the first guide means.

5. The fastener of claim 4, wherein the elements of the first guide means comprise slots and the elements of the second guide means comprise cooperating grooves.

6. The fastener of claim 4, wherein the elements of the first guide means comprise grooves and the elements of the second guide means comprise cooperating slots.

7. The fastener of claim 4, wherein the second guide means comprises a wall dividing the cavity in two, the wall cooperating with the slot.

8. The fastener of claim 1 wherein each locking means comprises a tab, the tab comprising the engaging surface and a leading surface extending obtusely from the outside edge of the resilient arm.

9. The fastener of claim 8, wherein each tab further comprises a surface, interposed between the engaging surface and the leading surface, adapted to slidably engage an inside surface of the cavity.

10. The fastener of claim 1, wherein the outside surface of each resilient arm curves concavely at its distal region and is adapted to engage the finger.

11. The fastener of claim 10, wherein the curved distal portion of the outside surface of the resilient arm is ridged.

12. The fastener of claim 1, wherein the receptacle and clasp each includes means for attaching a belt or the like thereto, at least one of the attaching means including means for selectively adjusting the length of the belt.

13. The fastener of claim 1 wherein the receptacle and clasp pieces are molded from a material selected from the group comprising nylon, acetal, and polypropylene.

14. A buckle comprising:

a receptacle and a clasp;

the clasp comprising a base, a substantially rigid stem extending substantially centrally from and normal to the base of the clasp, and a pair of resilient arms extending from the distal portion of the rigid stem having locking means disposed thereon and forming an arrowhead shape so that the receptacle and clasp become more tightly engaged when pulled apart without releasing the locking means;

the receptacle comprising two substantially parallel side surfaces, and an opening at one end adapted to receive the clamp piece, the opening forming a cavity within the body of the receptacle, the cavity defining top and the bottom inside surfaces and substantially parallel side inside surface, each of the top and bottom inside surfaces having a lock receiving means;

first guide means extending from the distal end along a substantial portion of the length of the rigid stem and a cooperating second guide means extending along an inside surface of the cavity, the first guide means comprising a slot that runs longitudinally through the rigid stem, splitting the stem into two separate pieces; and means for disengaging the locking means disposed on the resilient arms so that the receptacle and clasp may be separated.

15. The buckle of claim 14 wherein the included angle between the rigid stem and any of the resilient arms is about 15°, and the included angle between the resilient arms is about 30°.

16. The buckle of claim 14, wherein the first guide means comprises two elements that extend from the distal end along a substantial portion of opposite sides of the resilient member, and the second guide means comprises two elements, one along two opposite inside surfaces of the cavity, each element of the second guide means cooperating with the respective element of the first guide means.

17. The buckle of claim 16, wherein the elements of the first guide means comprise slots and the elements of the second guide means comprise cooperating grooves.

18. The buckle of claim 16, wherein the elements of the first guide means comprise grooves and the elements of the second guide means comprise cooperating slots.

19. The buckle of claim 16, wherein the second guide means comprises a wall dividing the cavity in two, the wall cooperating with the slot.

20. The buckle of claim 14, wherein each locking means comprises an engaging surface extending from an outside surface of a resilient arm, and the lock receiving means comprises a surface adapted to engage the engaging surface of the locking means.

21. The buckle of claim 20, wherein each locking means comprises a tab, the tab comprising the engaging surface and a leading surface extending obtusely from the outside edge of the resilient arm.

22. The buckle of claim 21, wherein each tab further comprises a surface, interposed between the engaging surface and the leading surface, adapted to slidably engage an inside surface of the cavity.

23. The buckle of claim 14, wherein the outside surface of each resilient arm curves concavely at its distal region and is adapted to engage the finger.

24. The buckle of claim 23, wherein the curved distal portion of the outside surface of the resilient arm is ridged.

25. The buckle of claim 14, wherein the receptacle and clasp each includes means for attaching a belt or the like thereto, at least one of the attaching means including means for selectively adjusting the length of the belt.

26. The buckle of claim 14 wherein the receptacle and clasp pieces are each integrally molded from a material selected from the group comprising nylon, acetal, and polypropylene.

* * * * *